US006089141A

United States Patent [19]

Okesaku

[11] Patent Number: 6,089,141

[45] Date of Patent: Jul. 18, 2000

[54] PLUNGER PUMP FOR WATER JET LOOM

[75] Inventor: Masahiro Okesaku, Komatsu, Japan

[73] Assignee: Hokuriku Seikei Industrial Co., Ltd., Ishikawa-ken, Japan

[21] Appl. No.: 09/007,482

[22] Filed: Jan. 15, 1998

[30] Foreign Application Priority Data

Mar. 25, 1997 [JP] Japan ..... 9-072203
May 20, 1997 [JP] Japan ..... 9-130187

[51] Int. Cl.[7] ..... F16J 1/10; F16J 15/18

[52] U.S. Cl. ..... 92/129; 92/165 R; 417/471

[58] Field of Search ..... 92/165 R, 129; 417/297, 471, 571

[56] References Cited

U.S. PATENT DOCUMENTS

| | | | |
|---|---|---|---|
| 817,381 | 4/1906 | Matson | 92/165 R X |
| 1,868,935 | 7/1932 | Breneman | 92/165 R X |
| 2,640,424 | 6/1953 | Babitch | 417/471 X |
| 4,541,788 | 9/1985 | Nomura et al. | 92/129 X |
| 4,736,675 | 4/1988 | Stoll | 92/165 R X |
| 5,085,129 | 2/1992 | Dugan | 92/129 X |
| 5,374,168 | 12/1994 | Kozawa et al. | 417/471 |
| 5,785,508 | 7/1998 | Bolt | 417/571 X |

FOREIGN PATENT DOCUMENTS

| | | | |
|---|---|---|---|
| 293605 | 7/1928 | United Kingdom | 417/571 |

*Primary Examiner*—Hoang Nguyen
*Attorney, Agent, or Firm*—Jordan and Hamburg LLP

[57] ABSTRACT

The straightness of the piston of a water jet loom plunger pump for discharging water under a high pressure is maintained to allow its smooth movement with respect to the cylinder. For this, a roller guide is arranged at a reciprocal piston actuating mechanism unit. By forming a bent tube at a water discharging passage from the cylinder to a conduit, moreover, the resistance to the water to be discharged from the cylinder is reduced. The piston is given a degree of freedom to move with respect to a drive member connected to a pump cam and a lever. This enables the piston to move with the least resistance in the cylinder.

8 Claims, 13 Drawing Sheets

PLUNGER PUMP FOR WATER JET LOOM

TECHNICAL FIELD

The present invention relates to a plunger pump for an automatic loom designed to insert weft by means of a water jet nozzle.

BACKGROUND ART

FIG. 1 shows the structure of a plunger pump of the prior art. This plunger pump acts as a prime mover for a high-speed loom up to 1,000 r.p.m. and is equipped at its one end with a suction ball valve 1 leading to a water source and at its other end with a conduit 3 leading to a water jet nozzle and a high-pressure water flow discharge ball valve or conical valve 2. The water is introduced from the conduit 3 into a cylinder 6, which is actuated by a pump cam lever 5 interlocked with a pump cam 4, by the forward movement of a piston 7 in the cylinder 6. When the pump cam 4 is in an idling position, the piston 7 is moved backwards by the resiliency of a spring mechanism 9 to discharge the introduced water as high-pressure water, and is fed from the conduit 3 through the ball valve or conical valve into the water jet nozzle.

FIG. 2 is a schematic diagram illustrating the pressure waveforms of the water which is discharged from the water jet nozzle unit of the plunger pump for discharging the high-pressure water. The pressure waveforms are ideal if they follow the dotted curve, as indicated, and it is preferable that the time $\Delta t$ spent achieving maximum pressure be short and that the fluctuation $\Delta p$ at the pressure drop from the maximum level be small.

As a matter of fact, the time $\Delta t$ is a factor determined by the relation between the spring pressure and the sectional area of the nozzle jet portion. Therefore, the most important factors for practically establishing the ideal waveforms of high-pressure water are a small pressure fluctuation $\Delta p$ and the elimination of the fine fluctuation of the waveforms. For this, it is essential to smooth the movements between the piston 7 and the cylinder 6 and to reduce fluid resistance.

In the high-speed loom, however, the spring pressure of the plunger pump exceeds 200 Kgf, and the clearance between the outer face of the piston 7 and the inner face of the cylinder 6 is formed to have a value of 10/1,000 mm to 30/1,000 mm, taken diametrically. As a result, the piston 7, into which the end of the connection mechanism unit is screwed, is subject to a pulling force towards a pivot pin 11 and the vibration pressure of a rocking mechanism or a spring so that the piston 7 and the cylinder 6 obliquely interfere, as shown in FIG. 3, to cause abnormal wear or to disable smooth movements. Thus, the injected water jet is adversely affected and is subjected to the influences of the flow resistance of the conduit by the disturbances of the discharged water in the conduit, so that the waveforms of the pressurized water are disturbed, as indicated by the solid curve of FIG. 2.

An object of the invention is to provide a structure for a water jet loom plunger pump which will discharge high-pressure water while maintaining the straightness of the piston, thereby retaining smooth movement between the piston and the cylinder.

Another object of the invention is to make it possible to reduce the clearance between the piston and the cylinder by maintaining the straightness of the piston, thereby eliminating the leakage of water from the piston and the cylinder.

Still another object of the invention is to reduce the fine adjustment for retaining the concentricity between the piston and the cylinder and the cost demanded for machining the internal and external diameters of the cylinder to such high precision.

A further object of the invention is to eliminate the defect of the discharged water flowing in a turbulent state into a ball valve or conical valve.

A further object of the invention is to provide a plunger pump which is able to eliminate the fluctuation of the waveforms of the pump water pressure, thereby ensuring a stable and reliable inserted weft at all times by eliminating the dispersion of the maximum water pressure and by minimizing the differential pressure $\Delta P$ of FIG. 2.

DISCLOSURE OF THE INVENTION

In this invention, a roller guide is arranged at a reciprocal piston actuating mechanism unit to maintain the straightness of the piston.

In this invention, moreover, the problem of the discharged water from the pump flowing in a turbulent state into a ball valve or conical valve is solved by connecting the structure of a discharge passage for high-pressure water discharged from the cylinder to turn at a right angle into a conduit by means of a curved tube, to reduce the resistance to the water to be discharged from the cylinder and by assembling a stabilizer upstream of the ball valve or conical valve.

Ideally, the shape of the discharge passage using the bent tube should be adopted together with the arrangement of a roller guide of the invention, but there can be adopted a structure in which the bent tube is exclusively added to the plunger pump of the prior art.

In this invention, moreover, a connection mechanism unit for connecting a drive member, as interlocked with a pump cam and a lever, and the piston can be given a structure having a degree of freedom which allows the piston to move radially.

Specifically, the structure is made so that the piston can be moved to the radial position having the least resistance at the instant just before the piston is reciprocated by the action of the pump cam lever, and the structure is made into a center-free structure in which the piston can be moved while being guided by the cylinder even during the reciprocations. As a result, it is possible to retain smooth movement between the piston and the cylinder, that is, the least resistant movement of the piston in the cylinder.

Figure 1:
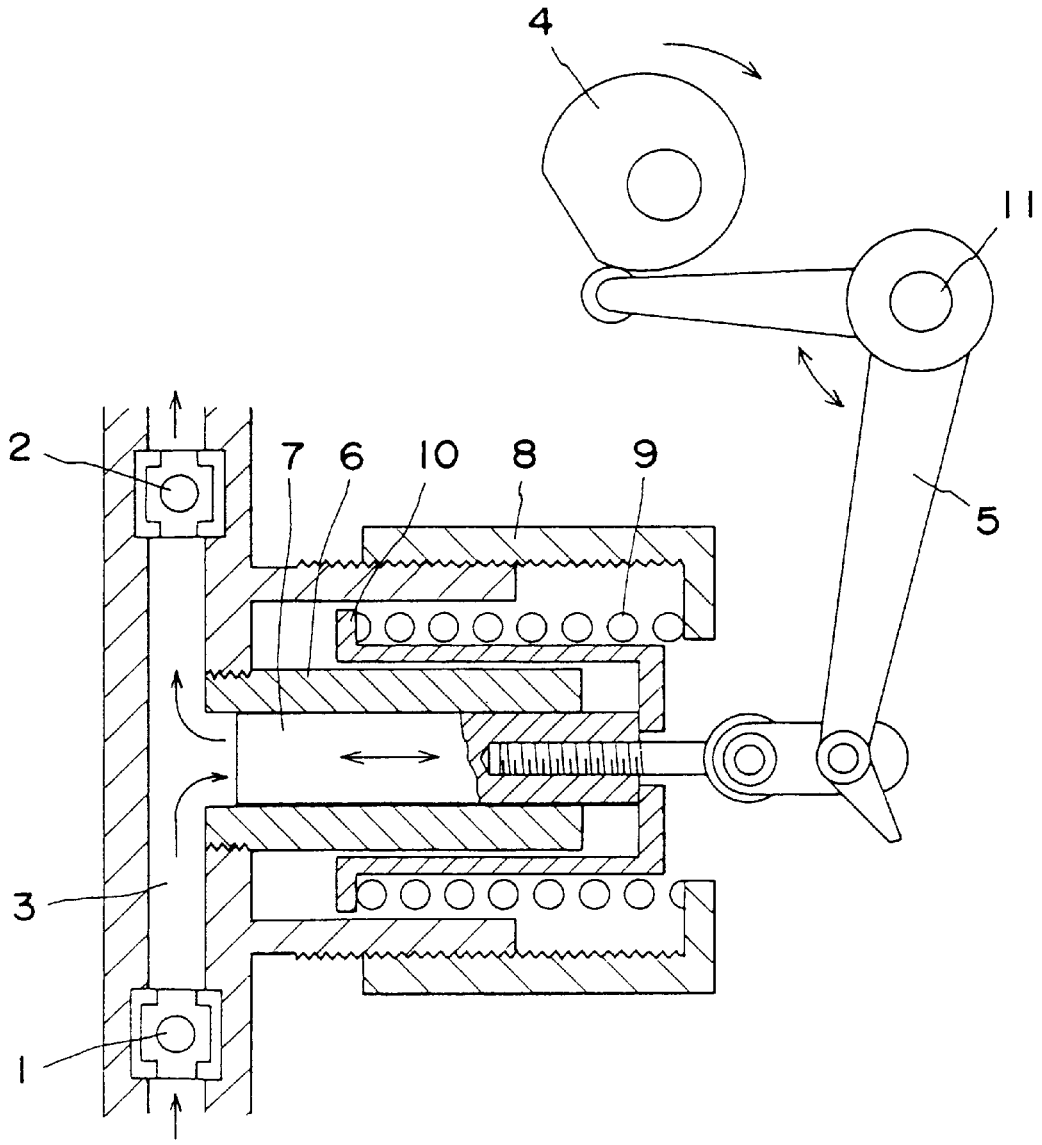
PRIOR ART FIG. 1
FIG. 1 shows a structure of a plunger pump of the prior art.
Figure 2:
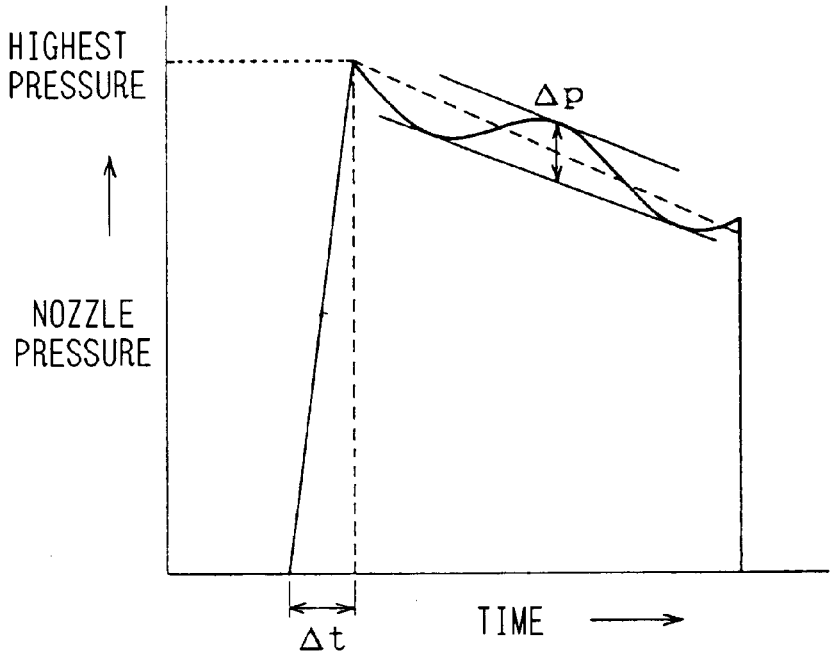
FIG. 2 illustrates pressure waveforms of the water discharged at a water jet nozzle portion.
Figure 3:
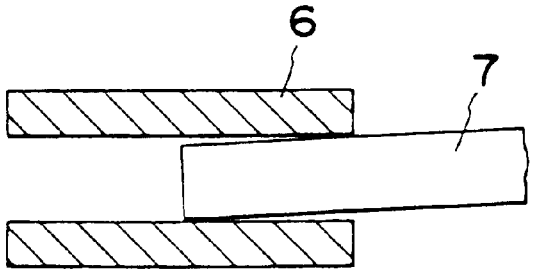
FIG. 3 is a diagram for explaining a problem of the plunger pump of the prior art.

The reference numerals of the individual Figures have the following designations:

1—Suction Ball Valve; 2—Discharge Ball Valve or Conical Valve; 3—Conduit; 4—Pump Cam; 5—Lever; 6—Cylinder; 7—Piston; 8—Stationary Casing; 9—Spring Mechanism; 10—Moving Casing; 11—Pivot Pin; 12—Interlocking Frame Rod; 13—Drive Member; 14—Substrate with Interlocking Frame Rod; 15—Roller Guide; 16—Connection Mechanism Unit of Drive Member and Piston; 17—Root End of Piston; 18—Leading End Portion of Drive Member; 19—Mounting Member of Connection Mechanism Unit; 20—Mounting Member Patch; 21—Bolt; 22—Stabilizer; 31—Bent Tube; 71—Rear Extension of Piston; 72—Piston Actuating Member; 81—Spring Receiving Seat; 82—Shaft of Spring Mechanism; 83—Adjust Thread; and 84—Adjust Nut.

BEST MODES FOR CARRYING OUT THE INVENTION

The modes of the invention will be described in connection with the following embodiments, to which the invention should not be limited.

Embodiment 1

Figure 4:
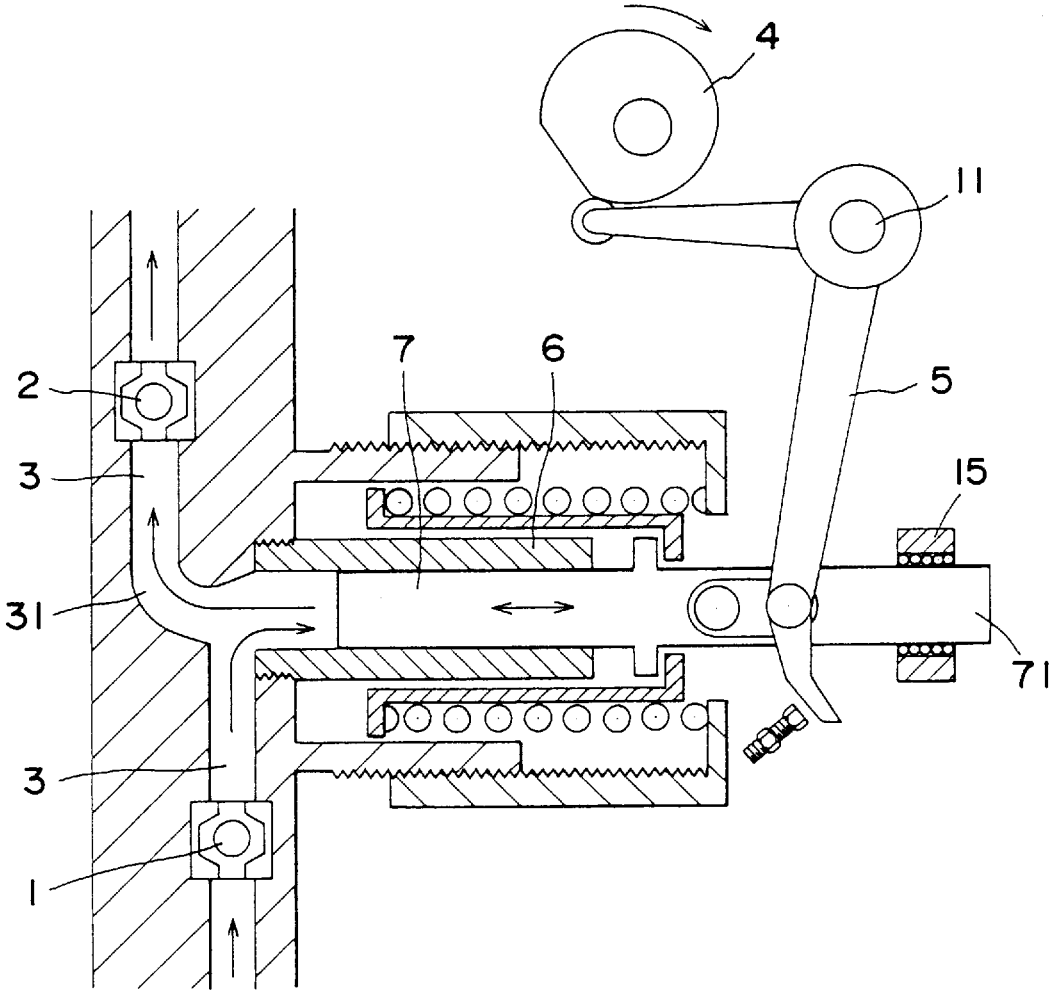
FIG. 4 shows a first embodiment of the invention.

FIG. 4 shows a first embodiment of the invention, which uses a roller guide 15 together with a bent tube connected to a water discharge line from a cylinder 6 to a conduit 3.

As shown in FIG. 4, the roller guide 15 is arranged around a rear extension 71 of a piston 7 which is actuated by a pump cam lever 5 interlocked with a pump cam 4. This roller guide 15 need not always be fixed but can slide by itself and is given a structure capable of setting the piston 7 in the optimum position for keeping the straightness of the piston 7.

In this structure, the straightness of reciprocations of the piston 7 in the cylinder 6 is kept at the time of discharge out of the conduit 3 into the cylinder 6 and vice versa thereby to ensure smooth movement of the piston 7. By forming a bent tube 31 in the discharge path portion of the water from the cylinder 6 to the conduit 3, moreover, the fluid resistance to the high-pressure water to be discharged from the cylinder can be drastically reduced to achieve a reliable weft inserting.

Embodiment 2

Figure 5:
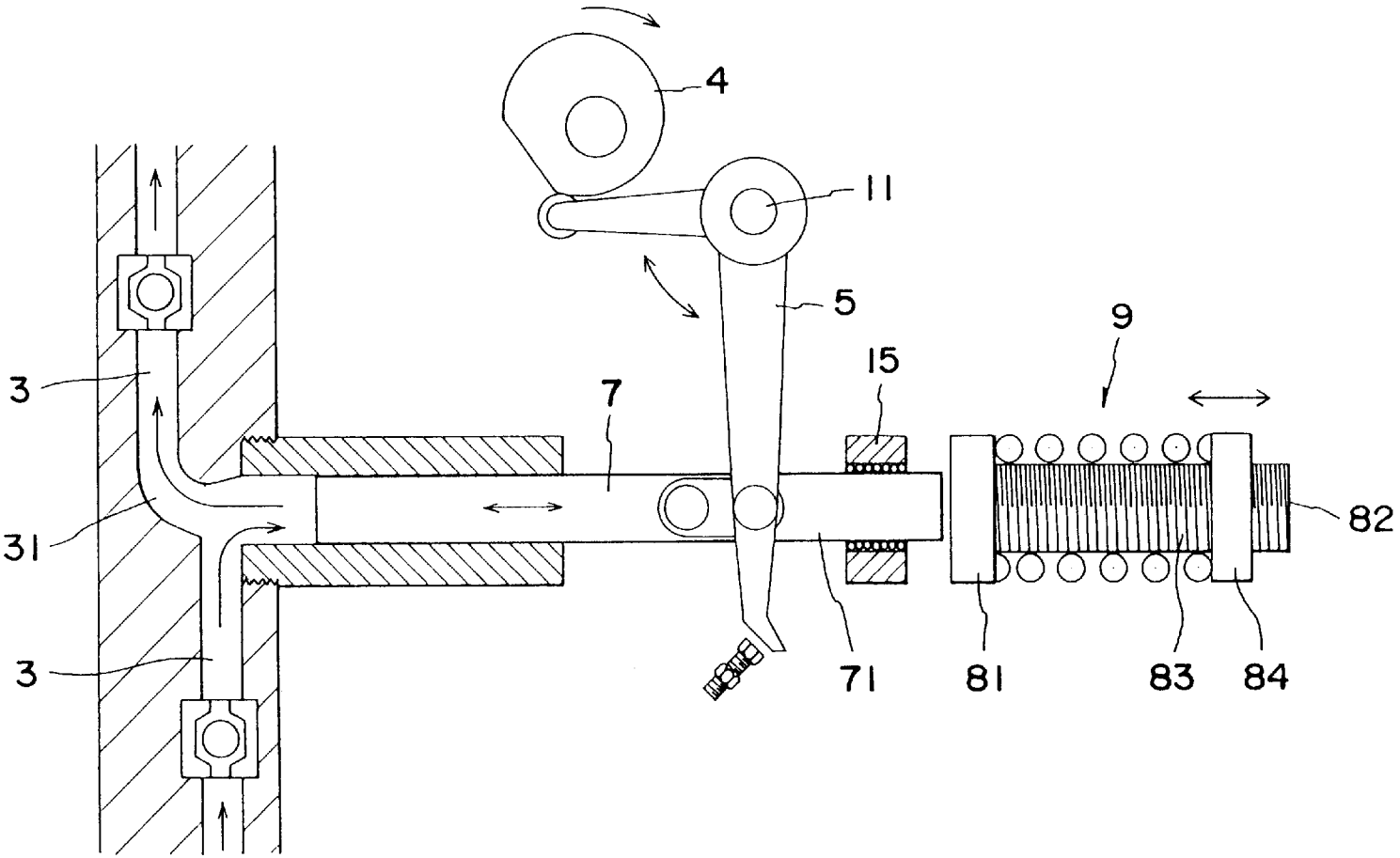
FIG. 5 shows a second embodiment of the invention.

In FIG. 5, the roller guide 15 is arranged along the outer face of the rear extension 71 of the piston 7, and a spring mechanism 9 is arranged at the rear end face of the rear extension 71.

This spring mechanism 9 is able to transmit the spring force to the piston 7 by a horizontally slidable spring receiving seat 81 and to adjust its resiliency by moving the position of an adjust nut 84 back and forth by an adjust thread 83 threaded in a shaft 82.

Since this spring mechanism 9 is arranged at a position different from that of the cylinder 6, there is more degree of freedom for designing the piston 7 and the cylinder 6 to sufficiently exhibit the demanded function of the spring mechanism 9 to change the diameter of the spring wire or the turning diameter. This makes it possible to sufficiently enhance the function of the plunger pump.

Embodiment 3

Figure 6:
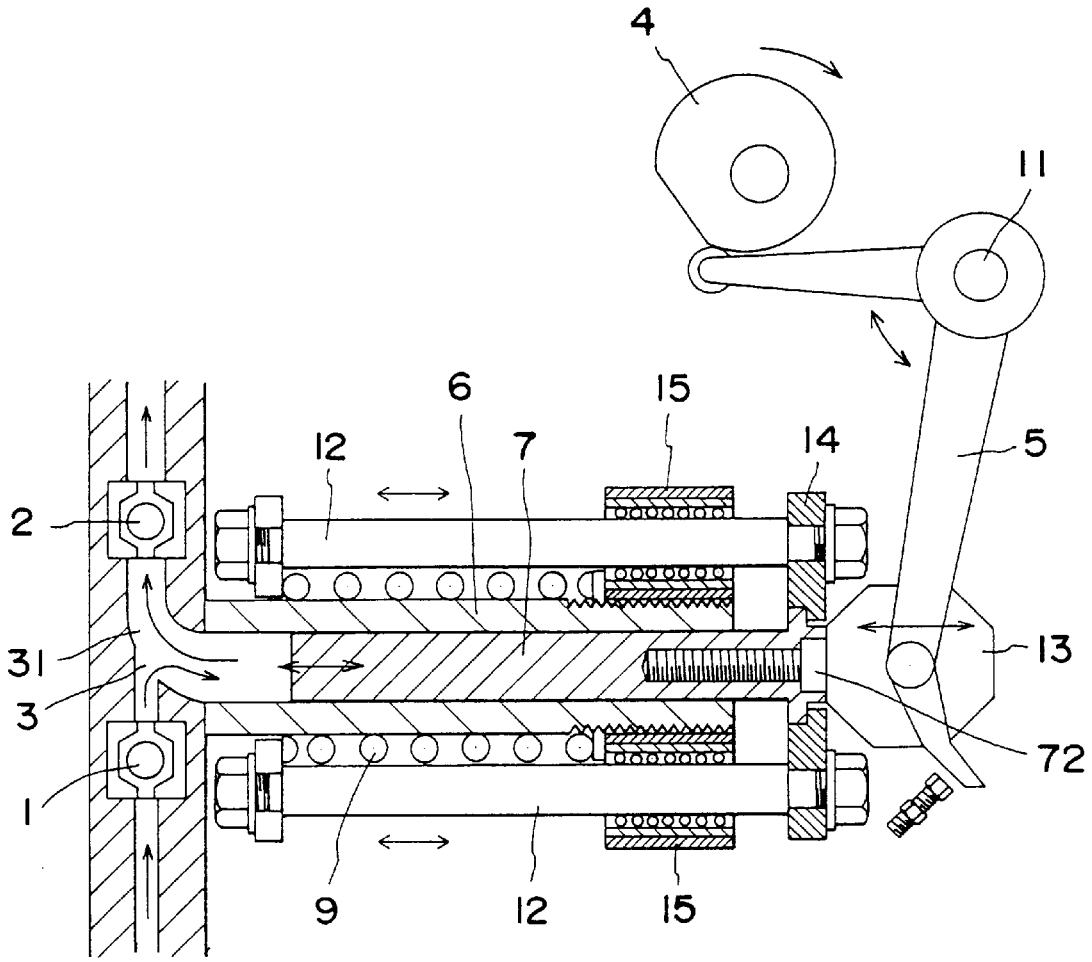
FIG. 6 shows a third embodiment of the invention.

FIG. 6 shows a construction for shortening the total length of the plunger pump of the invention. To the end face of the root portion of the piston 7, as shown in FIG. 6, there are connected the lever 5, rocked through its pivot pin 11 by the pump cam 4, a drive member 13 and a piston actuating member 72. Moreover, the end face of the root portion of the piston 7 is mounted through a mounting member 14 on a plurality of interlocking frame rods 12.

These interlocking frame rods 12 are reciprocated by the piston 7. Moreover, the interlocking frame rods 12 move against the biasing force of the spring mechanism 9 mounted on the outer circumference of the cylinder 6 and are abruptly moved backwards, when in the idling position of the pump cam 4, by the resiliency of the spring mechanism 9. Because of this, the water, as it is sucked by the piston 7 into the cylinder 6, is vigorously discharged under high pressure out of the bent tube 31 into the conduit 3 and further out of the discharge ball valve or conical valve 2 into the nozzle(not shown).

The roller guide 15 is arranged around at least one portion of each interlocking frame rod 12 to maintain the parallel condition of the interlocking frame rods 12 around the cylinder 6, thereby to retain the parallel condition of the reciprocations of the piston 7, which is interlocked with the interlocking frame rods 12.

Embodiment 4

Figure 7:
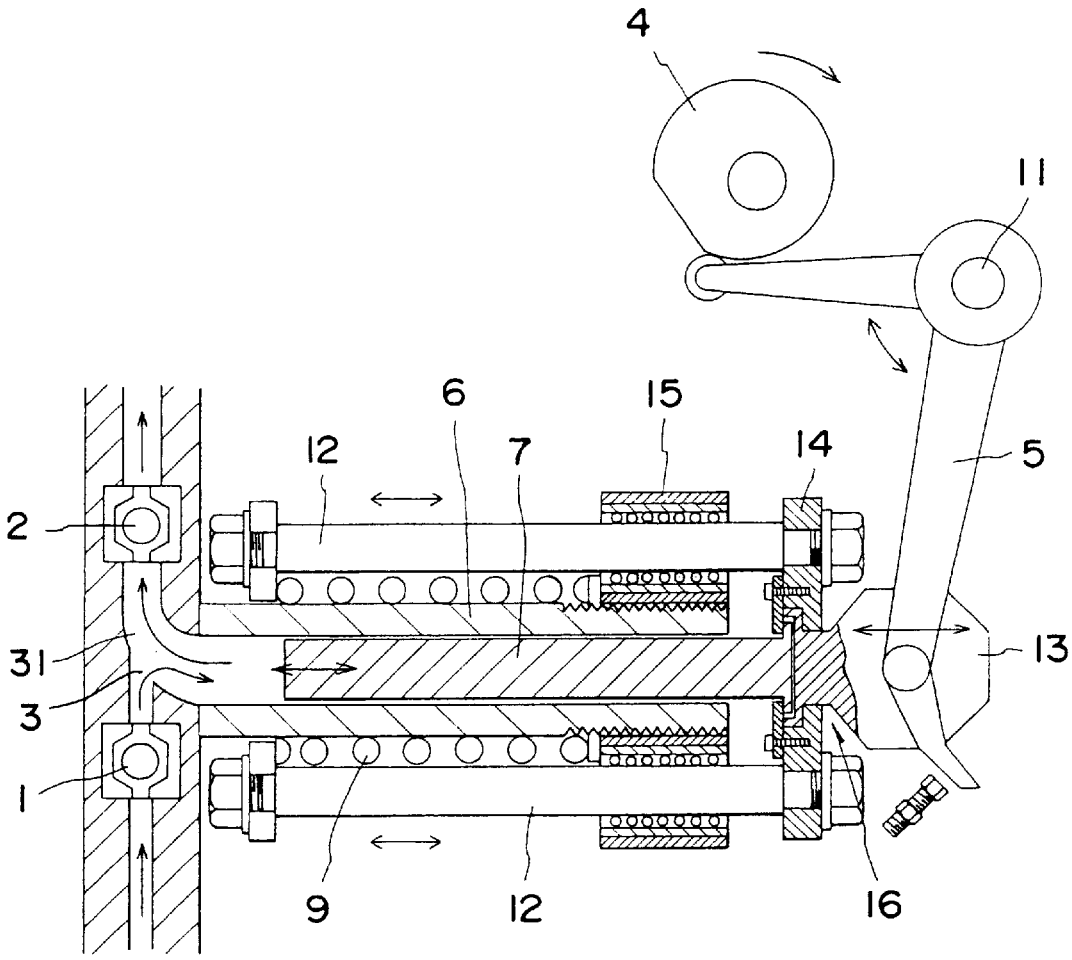
FIG. 7 shows a fourth embodiment of the invention.

FIG. 7 shows an embodiment in which the center free mechanism of the piston at the connection mechanism unit of the drive member and the piston is applied to the plunger pump with the roller guide. In this embodiment, The interlocking frame rods 12 having the spring mechanism 9 are interlocked with the lever 5 which is rocked through its pivot pin 11 by the pump cam 4. As the lever 5 reciprocates, the drive member 13 reciprocates the piston 7 in the cylinder 6 and interlocks the substrate 14 carrying the interlocking frame rods 12. At this time, the straightness between the interlocking frame rods 12 and the piston 7 moving in parallel with each other is maintained by the roller guides 15 which are arranged around the interlocking frame rods 12.

Here, this parallel condition can be improved by arranging two roller guides 15 around each interlocking frame rod 12.

Figure 8:
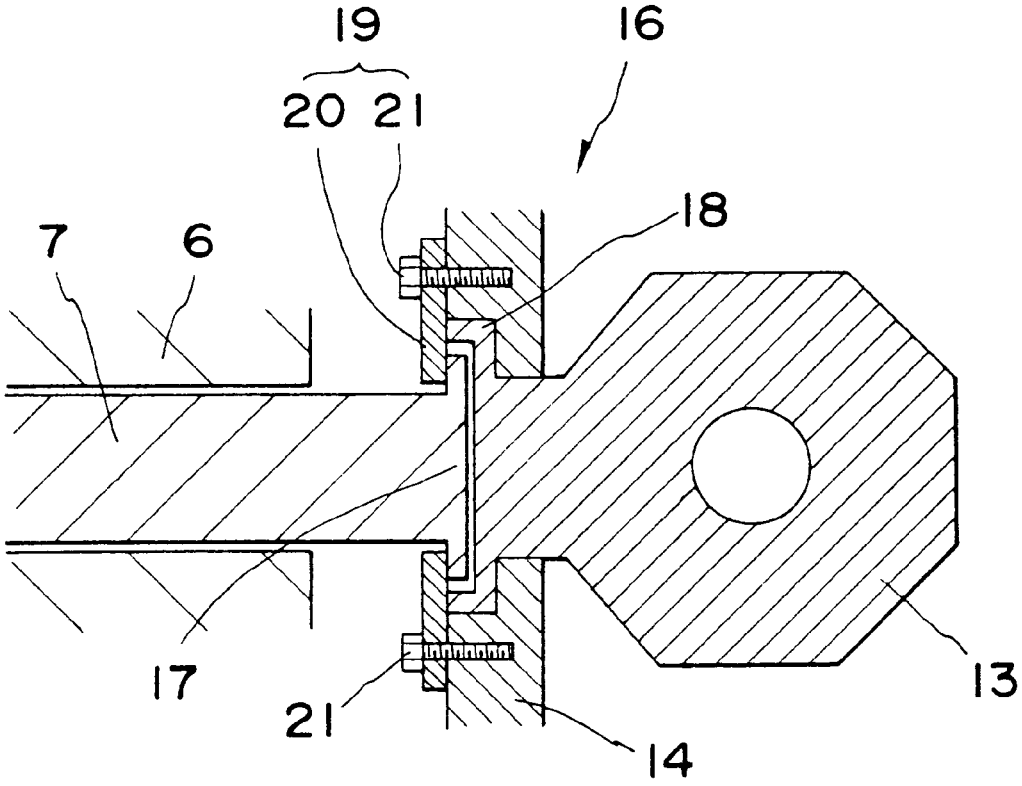
FIG. 8 shows in detail a connection mechanism unit connecting a drive member and a piston, as interlocked with a pump cam of FIG. 7.

Reference numeral 16 designates a connection mechanism unit between the drive member 13 interlocked with the pump cam and the piston 7. FIG. 8 shows a detail of this connection mechanism unit 16. As shown in FIG. 8, the root end 17 of the piston 7, as reciprocating in the cylinder 6, and the leading end fitting portion of the drive member 13, as connected to the rocking lever 5, are mounted in the fitting space which is formed in the substrate 14 mounting the interlocking frame rods 12, as shown in FIG. 7, and are mounted by a patch 20. Reference numeral 19 designates a member for mounting the connection mechanism unit 16 and is composed of the patch 20 and bolts 21.

A small clearance is left between the leading end fitting portion 18 of the drive member 13 and the flanged root end 17 of the piston 7, and a clearance is formed between the outer circumference of the root end 17 of the piston 7 and the inner circumference of the leading end fitting portion of the drive member 13 to allow radially free motions of the piston 7.

The radial clearance of the root end 17 of the piston 7 is required to have at least enough freedom to allow the piston 7 to move to a radial position having the least resistance immediately before it reciprocates in the cylinder 6 and while the same is reciprocating. This clearance depends upon the diameter of the piston 7 but may be no more than the difference, as ordinarily exemplified by 10/1,000 mm, between the external diameter of the piston 7 and the internal diameter of the cylinder 6. If the clearance is smaller than 10/1,000 mm, the motions of the piston 7 in the cylinder 6 are disturbed even with a slight deviation of the piston 7, and a step for fine adjustment to retain the concentricity between the piston 7 and the cylinder 6 is needed.

The clearance between the leading end fitting portion 18 of the drive member 13 and the root end 17 of the piston 7 may be sized to match the time allowance for the piston to freely move in a center-free state into the least-friction position at the instant it shifts from the backward to forward movements. An excess clearance will cause noise and abnormal wear due to the clattering. Here, this clearance also exhibits similar effects at the instant the piston 7 shifts from the forward to backward movements.

In this plunger pump, in accordance with the movements of the drive member 13 of the rocking lever 5 in the connection mechanism unit 16, the mounting substrate 14 of the interlocking frame rods 12 and the flanged root end 17 of the piston 7 move against the biasing force of the spring mechanism 9. Moreover, the interlocking frame rods 12, as arranged around the cylinder 6, are abruptly moved backwards, when in the idling position of the pump cam 4, by the resiliency of the spring mechanism 9. Simultaneously with this, the water, which has been sucked into the cylinder 6 by the piston 7, is abruptly discharged under high pressure from the bent tube to the conduit 3 and further from the discharge ball valve or conical valve 2 into the nozzle (not-shown).

The roller guide 15 is arranged around at least one portion of each interlocking frame rod 12 to maintain the parallel condition of the interlocking frame rods 12 around the cylinder 6 thereby to retain the parallel condition of the reciprocations of the piston 7 which is interlocked with the interlocking frame rods 12. As a result, the movements of the piston 7 in the cylinder 6 are effected with no resistance.

Moreover, the spring can be reduced to a diameter of about 8 mm from 10.5 mm of the prior art, and its force can be reduced to 60 to 70 Kgf so that the drive power against the force can be accordingly reduced.

Embodiment 5

Figure 9:
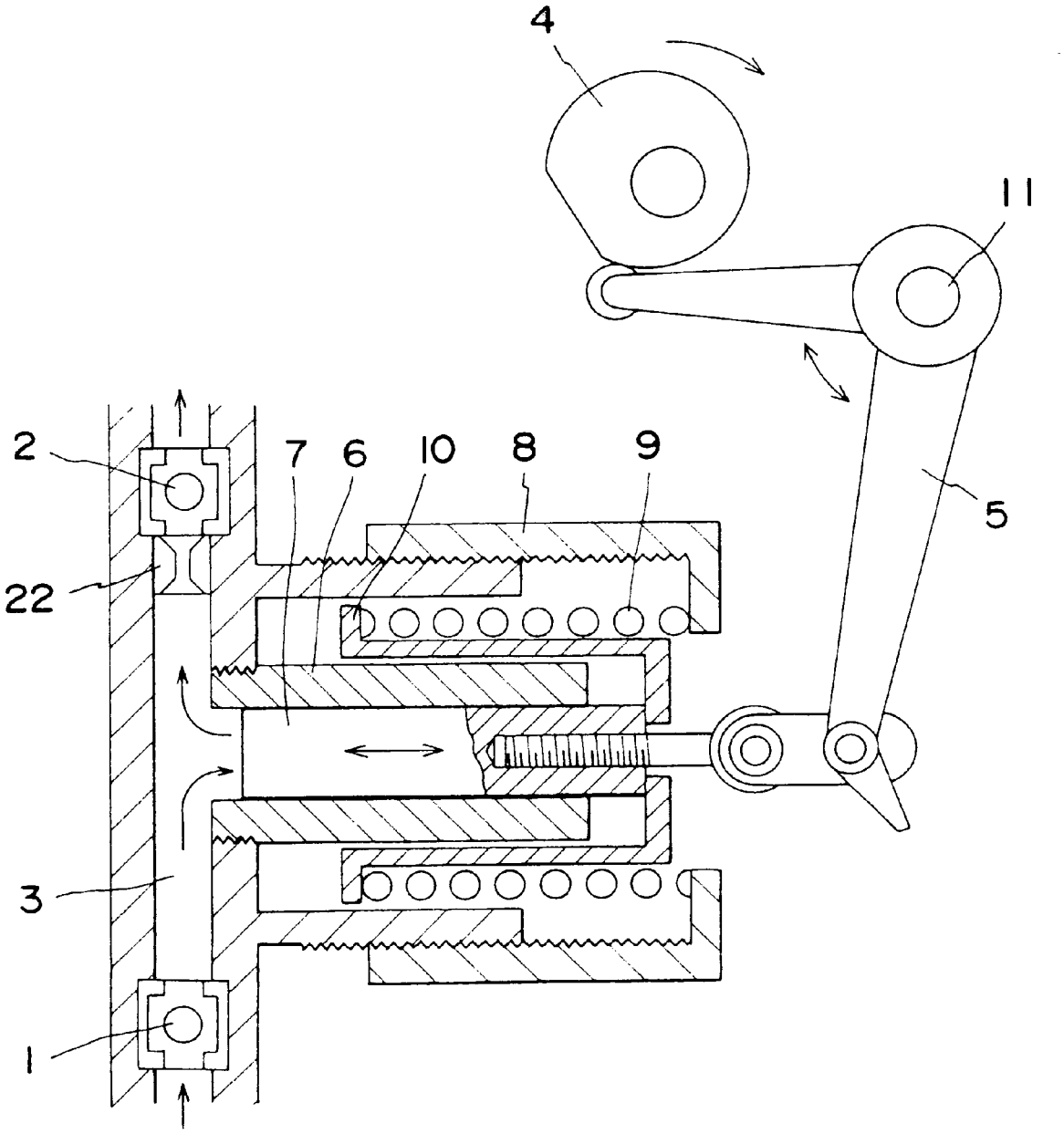
FIG. 9 shows another embodiment, in which a stabilizer is arranged upstream of a discharge ball valve or conical valve assembled in a conduit of the plunger pump.

FIG. 9 shows an embodiment in which a stabilizer 22 composed of a plurality of straightening blades is arranged upstream of the discharge ball valve or conical valve 2 assembled in the conduit 3 of the plunger pump. This stabilizer is equipped with a plurality of straightening 22*b* which are extended towards the axis from the inner circumference of a cylindrical member 22*a,* as shown in the top plan and side elevation in FIGS. 10(*a*) and 10(*b*).

Figure 11:
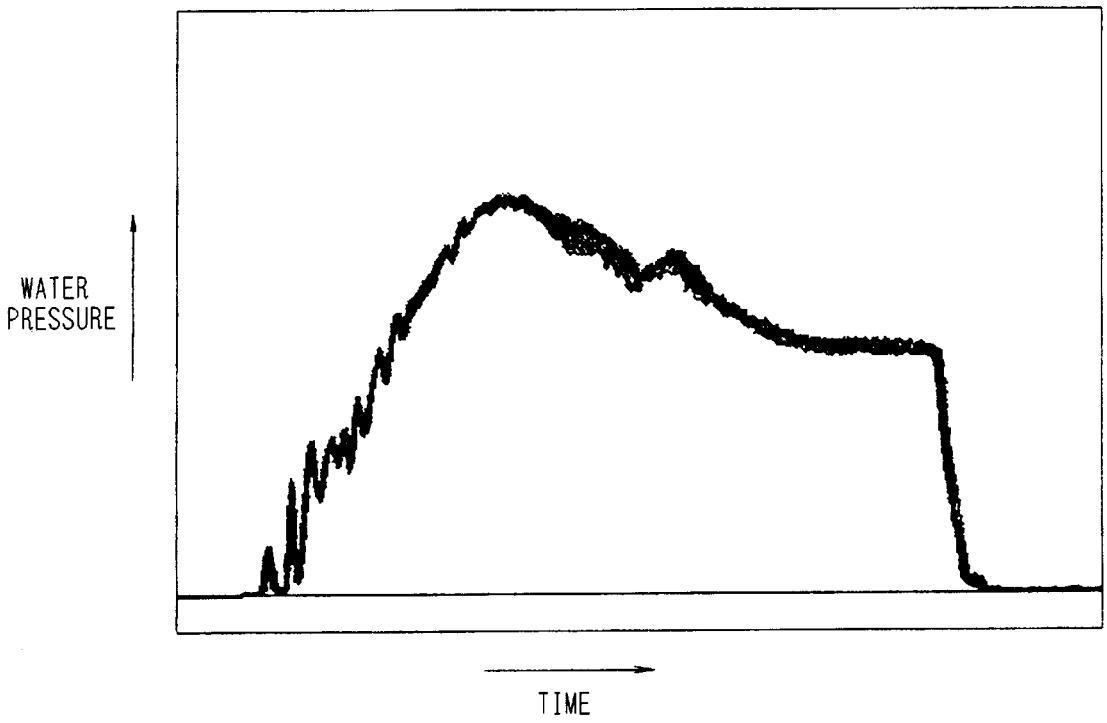
FIG. 11 is a diagram plotting the accumulated record of the pressure waveforms of the water which is discharged from the plunger pump of FIG. 9 having the stabilizer assembled in FIG. 1.
Figure 12:
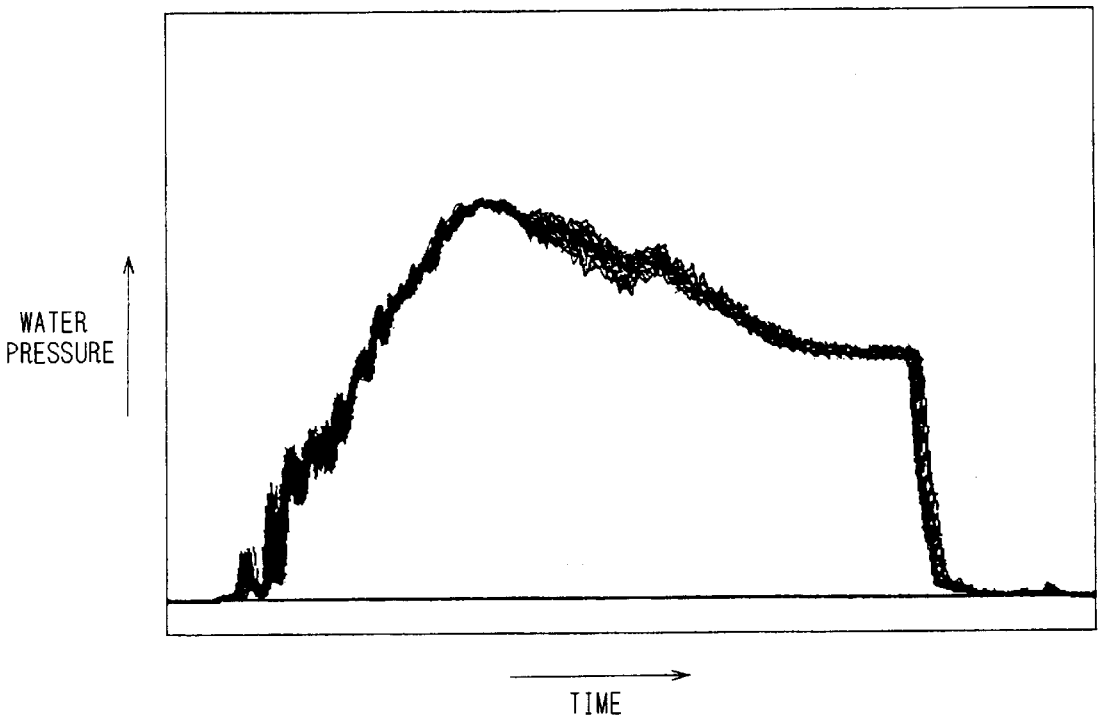
FIG. 12 is an accumulated record diagram of the pressure waveforms of the water which is discharged from the plunger pump of the prior art of FIG. 1.

The effects of this stabilizer were examined under the conditions of 7,000 r.p.m. for 30 seconds with the pressure waveforms of the water discharged from the plunger pump. FIG. 11 illustrates the accumulated record of the pressure waveforms. FIG. 12 illustrates the accumulated record of the pressure waveforms for no stabilizer. By comparing these, the pressure waveforms for the stabilizer of FIG. 11 are less deviated (in amplitude width) than those of FIG. 12. It is therefore found that stabilized high-pressure water is achieved with a reduced pressure fluctuation.

This stabilizer 22 can be exemplified by that which uses a well-known material and shape, as adopted in the water jet nozzle.

Embodiment 6

Figure 10:
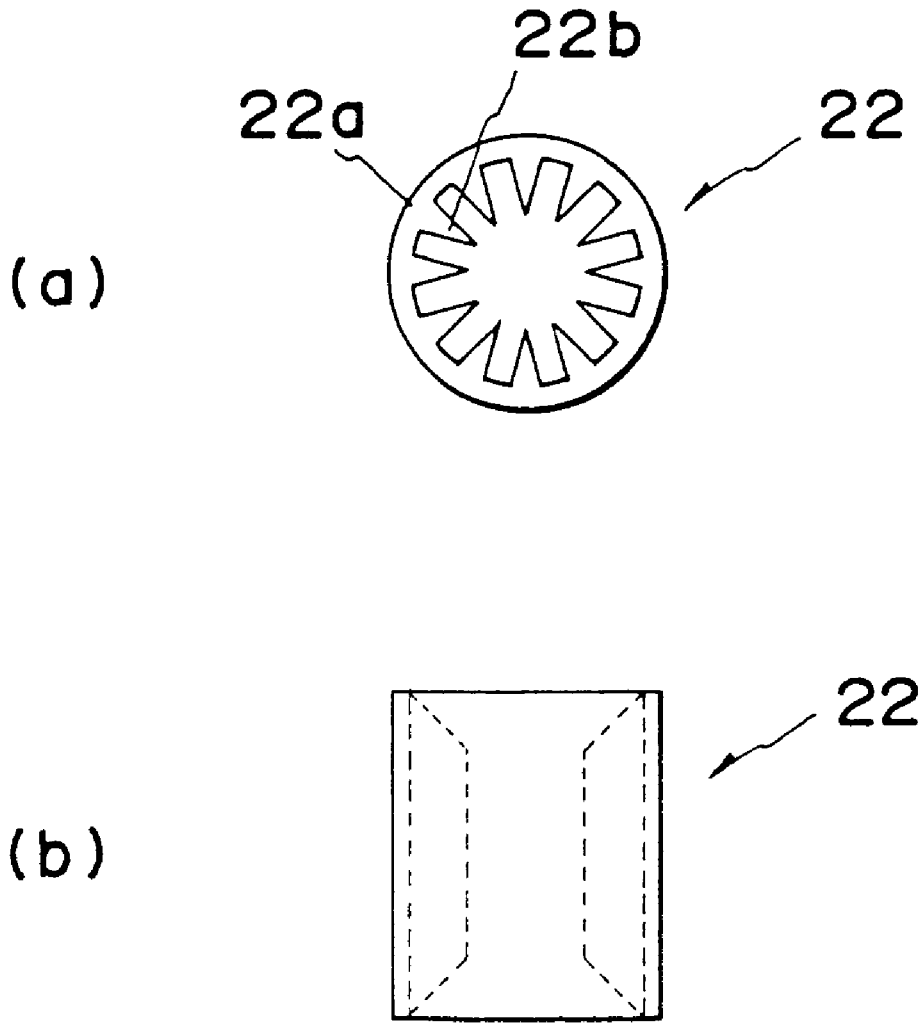
FIG. 10 shows a mode of straightening blades of the stabilizer.
Figure 14:
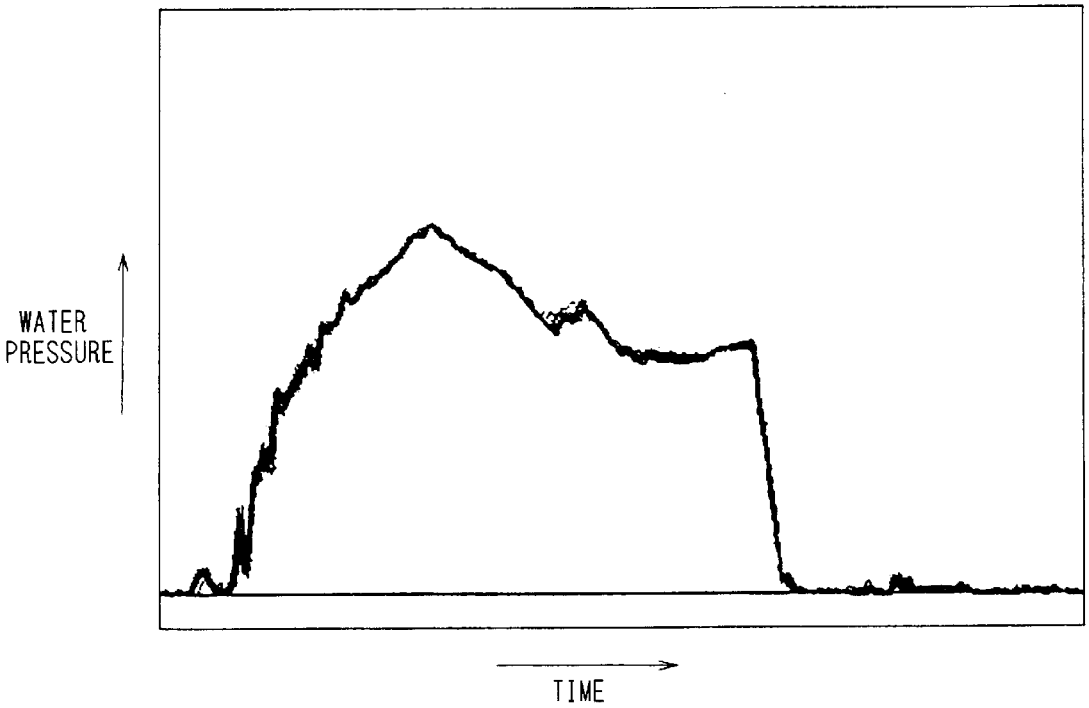
FIG. 14 is a diagram plotting the accumulated record of the pressure waveforms of the water which is discharged by the plunger pump of the invention according to the sixth embodiment.

Tests were conducted by assembling the stabilizer, as shown in FIG. 9 and FIGS. 10(*a*) and 10(*b*), into the plunger pump shown in FIG. 7. FIG. 14 illustrates the results of the accumulated record of the pressure waveforms of the discharged water, as established for 30 seconds (or 520 picks) by running the plunger pump having a piston diameter 12.5 mm and a spring pressure 70 Kgf at a weaving rate of 1,040 r.p.m. This diagram illustrates that the pressure waveforms are substantially identical for every pick, and that the discharged water is very stable. It is therefore found that the water jet injected has excellent convergence and that the fabric obtained is of a top-grade without any weaving irregularity. Moreover, the flow rate of water is 1 cc per pick so that the weft can be picked at this extremely low flow rate.

Figure 13:
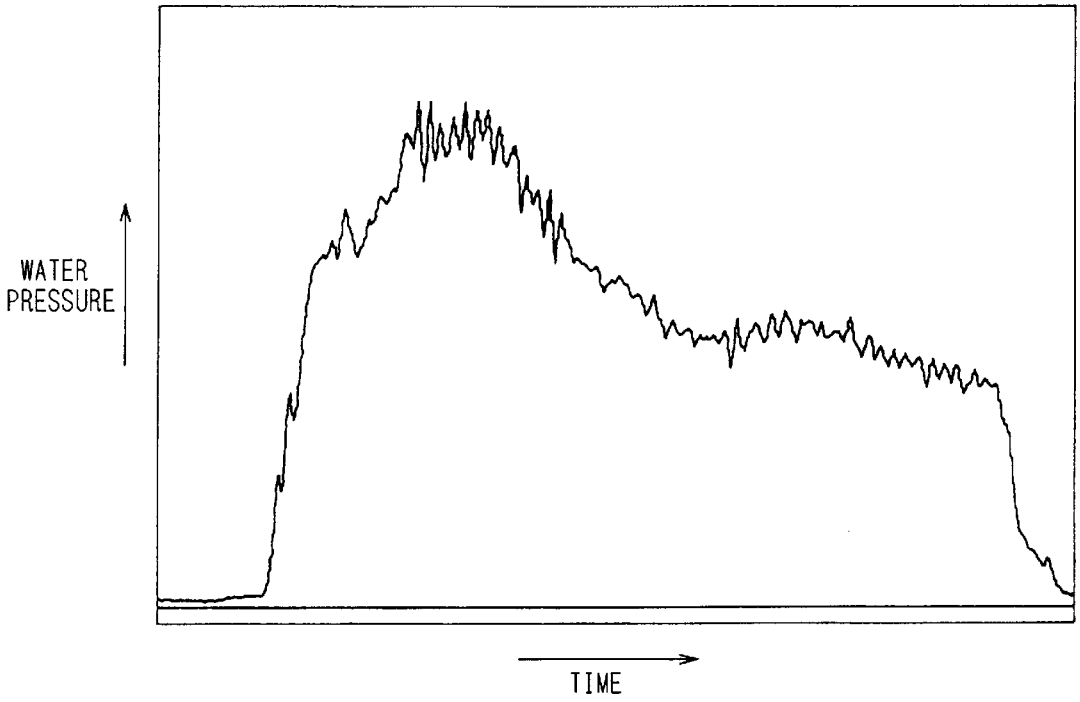
FIG. 13 plots the pressure waveforms per pick of the water which is discharged by the plunger pump of the prior art.

For comparison, performance tests were also performed with the plunger pump of the prior art shown in FIG. 1. FIG. 13 illustrates the results of the pressure waveforms of the discharged water as established for each pick (corresponding to one reciprocation of the piston) when a predetermined water jet nozzle was attached to the plunger pump having a piston diameter of 16 mm and a spring pressure 200 Kgf, and run at a weaving rate of 800 r.p.m. In this prior art example, as illustrated, the pressure waveforms have continuous zigzags indicating inferior convergence of the water jet flow. Moreover, the injection flow rate was 2.2 to 3 cc per pick.

INDUSTRIAL APPLICABILITY

According to this invention, it is possible to provide a plunger pump for an automatic loom having the following characteristics.

(1) Excellent parallel condition of the piston in the cylinder can be retained to discharge a remarkably stable water jet under a high pressure and at a high rate.

(2) The resistance to the movements of the piston in the cylinder can be minimized to drastically improve the discharge efficiency and to smoothly discharge the stable water jet under a high pressure and at a high rate.

(3) The discharge efficiency can be enhanced by this simple structure without changing the fundamental structure of the prior art in the least.

(4) The vibration of the piston can be remarkably reduced to establish a water jet without any pressure dispersion.

(5) The piston and the cylinder are rarely broken or abnormally worn, and have improved durability.

(6) The clearance between the piston and the cylinder can be reduced to discharge the water without leakage or pressure attenuation.

(7) The loom is rarely interrupted due to plunger pump trouble or weft insertion failure, so that the operation rate of the loom is improved.

(8) The spring pressure can be reduced to about ⅓ (e.g., 70 Kgf) that of the prior art so that the operational energy consumption can be accordingly reduced.

(9) The water injection flow rate per pick can be reduced to one half (e.g., 1 cc) or less that of the prior art.

(10) A stable water discharge pressure can be established to eliminate the tension fluctuation of the weft by the water jet and to produce a fabric having an excellent texture.

(11) The convergence of the water jet to be injected from the water jet nozzle can be remarkably improved to increase the number of revolutions of the loom per minute.

I claim:

1. A water jet loom plunger pump for discharging and feeding water under a high pressure into a water jet nozzle, comprising:

a cylinder;

a piston movable within the cylinder;

a pump cam lever interlocked with a pump cam for moving the piston in a first direction to introduce water from a conduit into the cylinder;

a spring mechanism for biasing the piston in a second direction opposite said first direction, said piston being actuated by operation of the spring in the second direction when the pump cam is oriented in an idling position whereby water is discharged; and a reciprocal piston actuating mechanism unit including a roller guide, said piston actuating mechanism being positioned behind the piston in said first direction to maintain straightness of the piston.

2. A water jet loom plunger pump as set forth in claim 1, wherein said roller guide is arranged at a rear extension, as actuated by the pump cam lever interlocked with the pump cam, of the piston.

3. A water jet loom plunger pump as set forth in claim 2, wherein said spring mechanism confronts the rear end of the piston.

4. A water jet loom plunger pump as set forth in claim 1, further comprising interlocking frame rods connected to a root end of the piston and arranged around the cylinder, said roller guide being fixedly mounted around each of the interlocking frame rods.

5. A water jet loom plunger pump for discharging and feeding water under a high pressure into a water jet nozzle, comprising:

a cylinder;

a piston movable within the cylinder;

a pump cam lever interlocked with a pump cam for moving the piston in a first direction to introduce water from a conduit into the cylinder;

a spring mechanism for biasing the piston in a second direction opposite said first direction, said piston being moved by operation of the spring in the second direction when the pump cam is oriented in an idling position;

a discharge path of the high-pressure water to be discharged from the cylinder includes a bent portion connecting a cylinder discharge portion of the discharge path to the conduit arranged crosswise thereto.

6. A water jet loom plunger pump for discharging and feeding water under a high pressure into a water jet nozzle, comprising:

a cylinder;

a piston movable within the cylinder;

a pump cam lever interlocked with a pump cam for moving the piston in a first direction to introduce water from a conduit into the cylinder;

a spring mechanism for biasing the piston in a second direction opposite said first direction, said piston being moved by operation of the spring in the second direction when the pump cam is oriented in an idling position;

a connection mechanism unit connected with a drive member guided by a roller guide which is interlocked with the pump cam and the lever, the piston reciprocating in the cylinder being formed in a rod shape having a uniform diameter over a length thereof, the connection mechanism being given a structure having a degree of freedom by an aperture which allows the piston to move in radial directions.

7. A water jet loom plunger pump for discharging and feeding water under a high pressure into a water jet nozzle, comprising:

a cylinder;

a piston movable within the cylinder;

a pump cam lever interlocked with a pump cam for moving the piston in a first direction to introduce water from a conduit into the cylinder;

a spring mechanism for biasing the piston in a second direction opposite said first direction, said piston being moved by operation of the spring in the second direction when the pump cam is oriented in an idling position;

a stabilizer for straightening the high-pressure water discharged from the cylinder is comprised of regulation blades, said stabilizer being arranged upstream of a discharge valve.

8. A water jet loom plunger pump as set forth in claim 7, wherein said discharge valve is one of a ball valve and a conical valve.

* * * * *